US009689255B2

(12) United States Patent
Samworth et al.

(10) Patent No.: US 9,689,255 B2
(45) Date of Patent: Jun. 27, 2017

(54) APPARATUS AND METHODS FOR ORIENTING, STABILIZING, OR STABLY OPERATING A LOGGING TOOL

(75) Inventors: James R. Samworth, Warwickshire (GB); Michael J. Chaplin, Warwickshire (GB)

(73) Assignee: Reeves Wireline Technologies Limited, Leicestershire (GB)

( * ) Notice: Subject to any disclaimer, the term of this patent is extended or adjusted under 35 U.S.C. 154(b) by 835 days.

(21) Appl. No.: 13/266,951

(22) PCT Filed: Oct. 12, 2011

(86) PCT No.: PCT/GB2011/051976

§ 371 (c)(1),
(2), (4) Date: Jan. 18, 2013

(87) PCT Pub. No.: WO2012/049506

PCT Pub. Date: Apr. 19, 2012

(65) Prior Publication Data

US 2013/0104641 A1 May 2, 2013

(30) Foreign Application Priority Data

Oct. 13, 2010 (GB) ..... 1017243.5

(51) Int. Cl.
*E21B 17/10* (2006.01)
*E21B 47/00* (2012.01)
(Continued)

(52) U.S. Cl.
CPC ..... *E21B 49/00* (2013.01); *E21B 17/1021* (2013.01); *E21B 47/00* (2013.01); *E21B 47/08* (2013.01)

(58) Field of Classification Search
CPC .. E21B 17/10; E21B 17/1014; E21B 17/1021; E21B 17/1042; E21B 47/08; E21B 49/00; E21B 47/00; G01V 11/002
See application file for complete search history.

(56) References Cited

U.S. PATENT DOCUMENTS 3,349,498 A * 10/1967 Oliver et al. ..... 33/544.3
3,356,146 A * 12/1967 Anderson ..... 166/241.5
(Continued)

OTHER PUBLICATIONS

International Preliminary Report on Patentability and Written Opinion received in corresponding PCT Application No. PCT/GB2011/051976, dated Apr. 16, 2013, 7 pages.
(Continued)

*Primary Examiner* — Robert E Fuller
*Assistant Examiner* — Christopher Sebesta
(74) *Attorney, Agent, or Firm* — Blank Rome LLP

(57) ABSTRACT

A logging tool, toolstring (10), or element (19) comprises a stabilizer including a pair of moveable, rigid, main stabilizer arms (23, 24) that each is pivotably secured adjacent to one another at one end to the logging tool or toolstring. As a result the arms (23, 24) are moveable between a relatively retracted position on the one hand and a relatively advanced position on the other in which the main stabilizer arms diverge from one another and protrude from the logging tool so as to present a pair of main arm free ends (29, 31) that are spaced from an outer surface of the tool and are engageable with a borehole surface. The logging tool (10) or element (19) includes a mechanism for effecting coordinated, powered, linked movement of the main stabilizer arms (23, 24) between the retracted and advanced positions.

27 Claims, 6 Drawing Sheets

(51) Int. Cl.
*E21B 49/00* (2006.01)
*E21B 47/08* (2012.01)

(56) References Cited

U.S. PATENT DOCUMENTS 4,428,422 A 1/1984 Laurent
4,610,309 A 9/1986 O'Brien
4,874,060 A 10/1989 Guerendel et al.
4,898,237 A 2/1990 Wittrisch
4,914,826 A * 4/1990 Nold, III ..... E21B 17/1021 33/544
5,251,479 A 10/1993 Siegried, II et al.
5,259,452 A 11/1993 Wittrisch
5,596,142 A * 1/1997 Delpuech et al. ..... 73/152.17
5,680,049 A 10/1997 Gissler
5,808,191 A * 9/1998 Alexy et al. ..... 73/152.03
6,065,218 A * 5/2000 Edwards ..... 33/544
6,102,115 A * 8/2000 Hazen ..... E21B 47/01 166/250.16
6,702,010 B2 3/2004 Yuratich et al.
2007/0256828 A1* 11/2007 Birchak et al. ..... 166/249
2008/0135293 A1* 6/2008 Tashiro et al. ..... 175/45

OTHER PUBLICATIONS

Patent Examination Report No. 1 received in corresponding Australian Patent Application No. 2011315285, dated Apr. 4, 2014, 3 pages.
Patent Examination Report No. 2 received in corresponding Australian Patent Application No. 2011315285, dated Sep. 3, 2014, 3 pages.
Combined International Search Report and Written Opinion in counterpart PCT Appl. No. PCT/GB2011/051976, mail dated Oct. 5, 2012.
Combined Examination and Search Report in counterpart UK Appl. No. GB1017243.5, dated Feb. 14, 2011.
First Office Action in counterpart Canadian Appl. 2,814,390, mailed Mar. 11, 2015.

* cited by examiner

APPARATUS AND METHODS FOR ORIENTING, STABILIZING, OR STABLY OPERATING A LOGGING TOOL

FIELD OF THE DISCLOSURE

This invention relates generally to the orienting and/or stabilizing of logging tools and toolstrings.

BACKGROUND OF THE DISCLOSURE

The logging of geological formations is, as is well known, economically an extremely important activity. The invention is of benefit in logging activities potentially in all kinds of mining and especially in the logging of reserves of oil and gas.

Virtually all commodities used by mankind are either farmed on the one hand or are mined or otherwise extracted from the ground on the other, with the extraction of materials from the ground providing by far the greater proportion of the goods used by humans.

It is extremely important for an entity wishing to extract materials from beneath the ground to have as good an understanding as possible of the lithology of a region from which extraction is to take place.

This is desirable partly so that an assessment can be made of the quantity and quality, and hence the value, of the materials in question; and also because it is important to know whether the extraction of such materials is likely to be problematic.

In consequence, a wide variety of logging methods has been developed over the years. The logging techniques result in measurement of physical and chemical properties of a formation usually through the use of a logging tool or sonde that is lowered into a borehole (that typically is, but need not be, a wellbore) formed in the formation by drilling.

Typically, the tool sends energy into the formation and detects the energy returned to it that has been altered in some way by the formation. The nature of any such alteration is processed into electrical signals that are then used to generate logs (i.e. graphical or tabular representations containing much data about the formation in question).

The logging tools usually are elongate, rigid cylinders that might be 2 m or more in length and between about 57 mm (2¼inches) and 203 mm (8 inches) in diameter.

Different parts of a logging tool perform different functions, with for example one part designed to emit energy into a borehole; and another part intended to detect returned energy in accordance with the broadly stated principle of logging outlined above. In particular when considering those parts of a logging tool that detect and (in many cases) process the returned energy it is often strongly desirable for them to be pressed into intimate contact with the borehole surface (wall). In particular, it is often required for a specific part of the tool to be in such contact.

The same requirement also can arise in relation to the parts of a logging tool that emit energy into the formation; and even if this is not needed, it is often important to know the distance by which the energy-emitting and detecting part(s) of a logging tool are spaced from the borehole surface. The latter is referred to as the tool standoff, in respect of which a correction is frequently applied to the logged data so as to remove from the final log information deriving from the fluid in the borehole as opposed to the surrounding rock. This is because the borehole fluid information may, depending on the nature of the fluid, the type of tool, and the amount of standoff, be a significant perturbation to the data of interest to the log analyst or logging engineer.

Many logging tool designs include devices aimed at "eccentering" and stabilizing them inside the boreholes. "Eccentering" is a term understood by those of skill in the downhole device art, and typically refers to the act of making e.g. a downhole tool non-concentric with the borehole in which it resides.

Single spring stabilizer devices are frequently used. One further type of stabilizer is known as a dual V-bowspring, that forms a part of a density logging tool in which the emitting and receiving parts of the logging tool must be presented in contact with and parallel to the borehole wall.

The dual V-bowspring amounts to a pair of resiliently deformable arcuate members that resemble leaf springs. These members are slidably fixed at either end to the exterior of the logging tool such that they curve convexly outwardly away from the tool between the attachment points.

The ends are attached adjacent one another to the logging tool exterior surface. The arcuate members however diverge from one another in the regions between the attached ends so as to resemble a V-shape when the tool is viewed in cross-section. As a result, two spaced spring members lie between the logging tool and the wall of a borehole in which the logging tool is inserted. The resilient deformability of the members acting between the borehole wall and the logging tool proper provides a force that tends to press the opposite side of the logging tool into engagement or with close proximity to the wall.

The dual V-bowspring while effective in many situations suffers the disadvantage that it increases the tool diameter. This means that a tool including the dual V-bowspring cannot be used to log a well that is of restricted diameter; nor can it be "shuttled" in the well.

In the shuttling technique, a relatively small-diameter logging tool is conveyed over most of the depth of the well inside a shuttle cylinder that moves under fluid pressure inside drillpipe. The tool is caused to protrude from the downhole end of the cylinder once it reaches a location at which logging activity is to commence. Shuttling is particularly desirable since it protects the tool against damage over the major part of its travel from the surface location into the borehole. As a result, the logging tool may be deployed to its operative location very rapidly, thereby reducing the overall time to log a well. Additionally this technique is valuable in highly deviated or horizontal wells where the logging tools cannot descend into the well by gravity alone.

The deformable elements forming part of the V-bowspring however prevent the logging tool from fitting into the shuttle cylinder, the outer diameter of which is limited by the dimensions of the borehole or more commonly drillpipe inserted in it.

Even when shuttling is not required, however the dual V-bowspring can give rise to a particular type of error when for example the well is deviated or it extends essentially horizontally.

In this regard the wellbores that penetrate oil and gas fields for the purpose of exploration and hydrocarbon extraction frequently do not extend directly downwardly into the surface of the Earth over their whole lengths, or even at all in some cases. On the contrary, it is often a requirement for the wellbore initially to extend horizontally or at a slope in order to enter a region of rock containing hydrocarbons before changing direction in order to maximize the length of the wellbore lying within the oil/gas field. Indeed, for this reason and also to avoid undesirable rock types that may be unstable or difficult to drill easily, there may be multiple changes of direction along the length of a wellbore. Moreover, some wellbores may be drilled into mountainsides and may have as a result almost no vertically descending sections.

When a logging tool including a dual V-bowspring is conveyed along an inclined or horizontal section of a borehole there is a risk of the tool being pressed incorrectly against the borehole wall.

For example, when the borehole is horizontal and the tool rotates during deployment the V-bowspring members could engage the lowermost part of the wall such that the logging tool is pressed upwardly so as to engage the upper part of the borehole wall. If as is likely to be the case the requirement is to log the rock that lies beneath the borehole such a situation could be highly undesirable since it would not be apparent until after the logging pass was complete (or largely complete) that the tool was operating "upside down". Additionally in this situation, the weight of the logging tool acts against the springs, so diminishing the force with which the tool is pressed against the side of the well-bore. The logging operation in such a case would essentially be wasted since the accuracy of the resulting log would be unacceptable. Since logging is an expensive activity (especially if, as is very frequently the case, it is necessary to interrupt rig time in order to obtain a log) any action of the V-bowspring stabilizer that results in inversion of the logging tool, and hence wasted logging time, is highly undesirable.

It is also known to employ a single, rigid, retractable arm as a logging tool stabilizer. Such an arm may be contained in a recess formed in the outer casing of the tool. At one end, the arm is pivotably secured to the logging tool. A mechanism (such as a gear mechanism) is provided for the purpose of forcibly rotating the arm so that it protrudes at an angle to the tool body. In this condition, the resulting, free end of the rigid arm can press into the borehole wall and thereby stabilize the tool.

In use of such a single-arm arrangement, the tool is deployed into the borehole with the arm initially retained in the recess so that no part of the arm protrudes outwardly of the tool. Only once the tool is deployed to the desired location in the borehole is the arm caused to extend and stabilize the tool before logging commences.

Clearly, a tool including such an arrangement may be shuttled in the manner outlined above more readily than a tool including a dual V-bowspring, but the single arm stabilizer nonetheless suffers from disadvantages as explained below with reference to FIGS. 1 to 5.

FIGS. 1 to 4 are schematic, cross-sectional views of a logging tool 10 having a single extensible arm 13 as described. The logging tool 10 is in a section of borehole 11 that extends horizontally.

Logging tool 10 includes at least one energy emitter or receiver, represented by the feature 14, that for accurate use of the tool 10 must be correctly positioned relative to the wall 12 of the borehole 11. The tool 10 illustrated in FIGS. 1 to 4 may for example be a density tool in which the Gamma detector lies inside the tool 10 adjacent a Gamma-transparent window in the wall of the tool having a wear-resistant surface 14. It is generally believed that the surface 14 and indeed a further window via which Gamma radiation is emitted into the formation must be pressed into intimate contact with the wall 12 of the borehole 11 adjacent the rock being logged.

Such a situation is visible in FIG. 1, in which the tool 10 lies at the bottom of the horizontal borehole 11 with the rigid arm 13 extending directly vertically upwardly from the tool to engage the wall 12 at the topmost part of the borehole 11. In this configuration the tool is vertically below the arm and the arrangement is generally regarded as an idealized "good" operational arrangement as signified by the legend in the figure.

However, as shown in FIG. 2, in which the arm 13 is inclined relative to the vertical, it is not necessary for the centre line of the tool/arm combination to extend vertically downwardly. On the contrary as signified by FIG. 2 as long as the Gamma detector window/wear surface 14 is pressed into engagement with the borehole wall in the vicinity of the rock formation to be logged it remains possible to complete a good quality log even though the tool/arm combination is not extending vertically downwardly.

Equally, as shown in FIG. 3, it is possible for the arm 13 to align vertically in the borehole 11 in a way that prevents good quality logging. In this example by reason of the tool/arm combination spanning a chord of the circular cross-section of the borehole 11, and not its diameter, there exists a gap 16 between part of the Gamma detector window 14 and the wall 12. This causes inaccuracies in the resulting density logs even if the orientation of the tool 10 seemingly is correct (by reason of being vertical as shown).

FIG. 4 shows a further sub-optimal mode of operation, in which the tool/arm combination spans a chord of the borehole cross-section and is inclined at an angle. Again this results in the gap 16 that prevents accurate logging by reason of creating an unpredictable degree of standoff and/or causing perturbation of emitted and returned radiation quanta by reason e.g. of interactions with the borehole fluid.

In view of the foregoing, there is a need to improve logging tool stabilizing arrangements in order to prevent or reduce faulty situations of the kinds explained.

According to the invention in a first aspect there is provided a logging tool or toolstring, or an element therefor, comprising a stabilizer including a pair of moveable, rigid, main stabilizer arms that each is pivotably secured adjacent to one another at one end to the logging tool, toolstring or element so as to be moveable between a relatively retracted position on the one hand and a relatively advanced position on the other in which the main stabilizer arms diverge from one another and protrude from the logging tool, toolstring or element so as to present a pair of main arm free ends that are spaced from an outer surface of the tool, toolstring or element and are engageable with a borehole surface, the logging tool, toolstring or element including a mechanism for effecting coordinated, powered, linked movement of the main stabilizer arms between the retracted and advanced positions.

In particular, and importantly, the coordinated movement of the arms preferably is synchronised movement.

When a stabilizer arrangement as defined is used together with a single arm device as previously described, and when the dual arm device is actuated after the single arm one, it tends to prevent the problem of inverted stabilizing of a logging tool.

Conveniently, the mechanism links the main stabilizer arms such that a stabilizing force is applied via the respective arms in proportion to forces exerted by the said arms.

An advantage of this arrangement is that for example when only one of the main stabiliser arms is in contact with a borehole wall 100% (or nearly 100%) of the stabilizing (restoring) force provided by the apparatus is applied via the arm in contact.

In other words, the mechanism is capable of automatically allocating the stabilizing force via the main stabiliser arms in proportion to the borehole wall force experienced by each of the arms.

One example of a mechanical arrangement for achieving this effect is described herein. Numerous further arrangements are possible within the scope of the invention.

Preferably, the tool or toolstring includes formed in an outer surface thereof one or more recesses each for receiving therein at least one of the main stabiliser arms so that in the relatively retracted position the main stabiliser arms are flush with or are recessed relative to the said outer surface.

The apparatus of the invention therefore avoids a drawback of the dual V-bowstring that the diameter of the resulting tool and stabilizer combination is too large to permit shuttling operation. This is because when the stabilizer arms occupy their retracted positions the diameter of the tool is determined by the dimensions of the tool casing, and no part of the stabilizer mechanism at such a time protrudes externally of the tool body. Therefore the tool/toolstring/element of the invention may fit inside a shuttle cylinder without problems.

A further drawback of the dual V-bowspring is that the forces applied by the two springs are independent of each other, and it is highly advantageous that the two arms in the apparatus of the invention to be linked and coordinated as described herein.

The tool/toolstring/element preferably includes formed in the outer surface thereof a pair of recesses in the form of slots that are each capable of receiving a respective rigid arm. This arrangement assures the reliable accommodation of the rigid arms when occupying their relatively retracted positions while permitting their forcible deployment to the advanced positions.

Conveniently, each main arm free end includes a portion that is shaped to promote stable engagement with a borehole surface. Specifically the said portion preferably includes a tip that is flattened in a region that is engageable with a borehole wall.

It is desirable to optimise the angle subtended between the rigid arms of the stabilizer. The following explanation addresses this aspect.

The forces generated by a single arm 13 as in the FIG. 4 situation are modeled in FIG. 5.

FIG. 5 is an analysis of forces diagram in which the FIG. 4 situation is simplified to show the tool/arm combination as a single, straight arm 13 spanning a chord as in FIG. 4. The contact point S of the tool with the wall 12 therefore is positioned at the bottom dead centre of the borehole cross-section, which by reason of ignoring the diameter of the cylindrical tool body may not be strictly accurate but is believed to be sufficient for modeling purposes.

Considering the reaction forces on the arm tip 13*a* with a sidewall force F, and taking moments about contact point S, the result is a clockwise moment from the normal reaction force from the borehole wall. This moment is resisted by an anti-clockwise frictional resistance moment tangential to the borehole wall.

Thus the restoring moment that tends to rotate the tool back to a position spanning the borehole diameter is given by:

$$F.\cos\theta.2.r.\cos\theta.\sin\theta - F.\cos\theta.k.2.r.\cos\theta.\cos\theta$$

in which r=well radius and k=coefficient of friction.

Initially assuming that the friction is zero, a plot of this restoring moment against the eccentric angle for different borehole sizes is as shown in FIG. 6 for a unit value of the sidewall force F.

The FIG. 6 plots goes through a peak at about 35 degrees, regardless of the borehole size.

A modified plot is shown in FIG. 7, in which a coefficient of friction between the arm tip 13*a* and the borehole wall 12 of 0.25 is assumed, being a typical but non-limiting value.

In FIG. 7, there is no net restoring moment until the angle θ, being the angle subtended between the arm 13 and a vertical bisector of the circular borehole cross-section as illustrated in FIG. 5, exceeds approximately 14 degrees. The borehole size-independent maximum force now arises at a value of θ of about 43 degrees.

SUMMARY OF THE DISCLOSURE

If it is now considered that the model described in FIG. 5 is one half of a linked pair of arms, it can be seen that the stable position will have each arm deployed at an angle of θ and any disturbance from the stable position will immediately attract a restoring moment appropriate to that angle.

The angle θ in FIG. 5 represents half the angle subtended between a pair of arms as in the apparatus of the invention. It follows that in a preferred embodiment of the invention the optimized angle subtended between the main stabilizer arms when occupying the relatively advanced positions is approximately 80 degrees and in a particularly preferred embodiment 86 degrees.

Notwithstanding the benefits of the invention as set out above, the basic arrangement as defined theoretically could give rise to stable, inverted positioning of the logging tool or toolstring. In order to eliminate this possibility the apparatus of the invention optionally may include an auxiliary stabilizer having a moveable, rigid auxiliary stabilizer arm that is pivotably secured at one end to the logging tool, toolstring or element so as to be moveable between a relatively retracted position on the one hand and a relatively advanced position on the other in which the auxiliary stabilizer arm protrudes from the logging tool, toolstring or element so as to present a further free end that is spaced from an outer surface of the tool and, along the length of the tool or toolstring, from the free ends of the main stabilizer arms; and that is engageable with a borehole surface.

Preferably, the auxiliary stabilizer is driven and controlled independently of the main stabilizer.

Preferably, the tool, toolstring, or element of the invention includes a recess for receiving therein the auxiliary stabilizer arm so that in its relatively retracted position the auxiliary stabilizer arm is flush with or recessed relative to the said outer surface.

This feature assures that the auxiliary stabilizer arm does not prevent shuttling deployment of the logging tool or toolstring containing it.

In its advanced position the auxiliary arm preferably aligns with a plane generally bisecting the angle subtended between the main stabilizer arms when in their advanced positions.

The arrangements described above advantageously may give rise to a deployment mode in which the auxiliary stabilizer arm is deployed to its advanced or extended position in a manner that prevents the main stabilizer arms from fixing the logging tool/toolstring in an inverted orientation with the energy emitting and detecting sections spaced from the borehole wall. This is usually achieved through a method, described below, involving actuating the auxiliary stabilizer arm in advance of the actuation of the main (dual) stabilizer.

Further in this regard in preferred embodiments of the invention there are provided a mechanism for effecting powered movement of the auxiliary stabilizer arm between its retracted and advanced positions; and a control device that causes movement of the auxiliary and main stabilizer arms in a sequence in which the auxiliary stabilizer arm adopts its advanced position before the main stabilizer arms adopt their advanced positions.

Conveniently, the apparatus of the invention includes at least first and second separable parts that in use are secured one to the other, the main stabilizer arms being pivotably secured to the first part and the auxiliary stabilizer arm being secured to the second part. In another preferred arrangement, at least one of the stabilizers is secured to a stabilizer element that is distinct from and connectable to the first and second separable parts so as to interconnect them. Such an element may be releasably connectable in the toolstring (e.g., as a means of joining two tools together).

Such arrangements permit the auxiliary and main stabilizer arms respectively to be secured to otherwise separate logging tools or other parts of a toolstring that are releasably securable together. Such tools may be operated essentially independently of one another or in a manner that combines the signals they generate in the production of logs. Examples of suitable logging tools that may be joined together to create a toolstring in accordance with the invention include but are not limited to a neutron density logging tool supporting the single stabilizer arm and associated control apparatuses; and secured at its uphole end an independent tool of another type supporting the main stabilizer arms and associated components defining the dual-arm stabilizer defined herein. As an alternative to the density logging tool one may consider a directional resistivity tool, being another type of logging tool that is often run in conjunction with a neutron density tool.

Depending on the precise tool types employed, the logging tool or toolstring of the invention also may include or have operatively connected thereto one or more of a caliper, shoe, or crank. A caliper is frequently included in e.g. a resistivity logging tool in order to provide a measure of variations in the borehole diameter as the logging operation proceeds. A shoe may be used to support a detector or some other aspect of the logging tool that needs to press over a portion of its length against the borehole wall; and a crank may be selectively employed to provide an offset so that the centreline of the tool lies spaced from the notional centreline of the borehole. Each of the foregoing features is familiar to and will be understood by the worker of skill in the art.

According to a second aspect of the invention there is provided method of stabilizing a logging tool or toolstring comprising a main stabilizer including a pair of moveable, rigid, linked main stabilizer arms that each is pivotably secured adjacent to one another at one end to the logging tool or toolstring so as to be moveable between a relatively retracted position on the one hand and a relatively advanced position on the other in which the main stabilizer arms diverge from one another and protrude from the logging tool so as to present a pair of main arm free ends that are spaced from an outer surface of the tool and are engageable with a borehole surface; and further comprising an auxiliary stabilizer having a moveable, rigid auxiliary stabilizer arm that is pivotably secured at one end to the logging tool or toolstring so as to be moveable between a relatively retracted position on the one hand and a relatively advanced position on the other in which the auxiliary stabilizer arm protrudes from the logging tool so as to present a further free end that is spaced from an outer surface of the tool and, along the length of the tool or toolstring, from the free ends of the main stabilizer arms, the method including the steps of (i) causing the auxiliary stabilizer arm to move from its retracted to its advanced position before (ii) causing the main stabilizer arms to move from their retracted positions to their advanced positions.

This method ensures that stabilised, inverted operation of the logging tool/toolstring in e.g. deviated or horizontal wells does not occur. The method is suitable for use in the apparatuses of the invention as defined above.

In more detail, preferably the steps (i) and (ii) take place when the main and auxiliary stabilizer arms are within a borehole, and the method further includes the steps of (iii) causing the auxiliary stabilizer arm to engage a surface of the borehole before (iv) causing at least one of the main stabilizer arms to engage the surface of the borehole.

These aspects of the method of the invention relate to operation of a logging tool or toolstring in a downhole environment.

Preferably, the method includes causing the main stabilizer arms to move simultaneously from their retracted positions to their advanced positions. However it is theoretically possible, and within the scope of the invention, to adopt a method of operation that involves deploying the main stabilizer arms individually in turn to their advanced (extended) positions, as long as they are linked once deployed.

Conveniently, the method includes operating one or more control devices controlling one or more mechanisms for effecting coordinated, powered movement of the main stabilizer arms between the retracted and advanced positions. The method also optionally includes operating one or more control devices controlling one or more mechanisms for effecting powered movement of the auxiliary stabilizer arm between its retracted and advanced positions.

The control devices may be common to the stabilizer mechanisms or may be provided separately. Moreover, they may be located on or in the tool or toolstring, or at a surface location with control commands being transmissible to the stabilizers using wireline, coded mud pulses, or any of a range of other known downhole communication techniques and apparatuses.

In another aspect, the invention resides in method of operating a logging tool or toolstring including carrying out the method steps up to and including deployment of the stabilizer arms to their advanced positions; and subsequently logging at least part of the borehole.

Optionally the method includes the step of the step (v) of causing the main and auxiliary stabilizer arms to move from their advanced to their retracted positions. Such an action is desirable at the end of a logging pass in order to facilitate retrieval of the logging tool/toolstring from the borehole, and also in the event of needing to abort a logging operation and retrieve the logging equipment in an emergency. Also of course, the ability to cause retraction of the stabilizer arms facilitates storage and transporting of logging tools constructed or operated in accordance with the invention.

When in their retracted positions the main and auxiliary stabilizer arms preferably occupy recesses formed in one or more outer surfaces of the logging tool or toolstring so that each said stabilizer arm is flush with or is recessed relative to a said outer surface. This aspect of the method gives rise to the advantages of flush storage of the arms as stated above.

BRIEF DESCRIPTION OF THE DRAWINGS

There now follow descriptions of preferred embodiments of the invention, by way of non-limiting example, with reference being made to the accompanying drawings in which.

DETAILED DESCRIPTION OF THE DISCLOSURE

Figure 8:
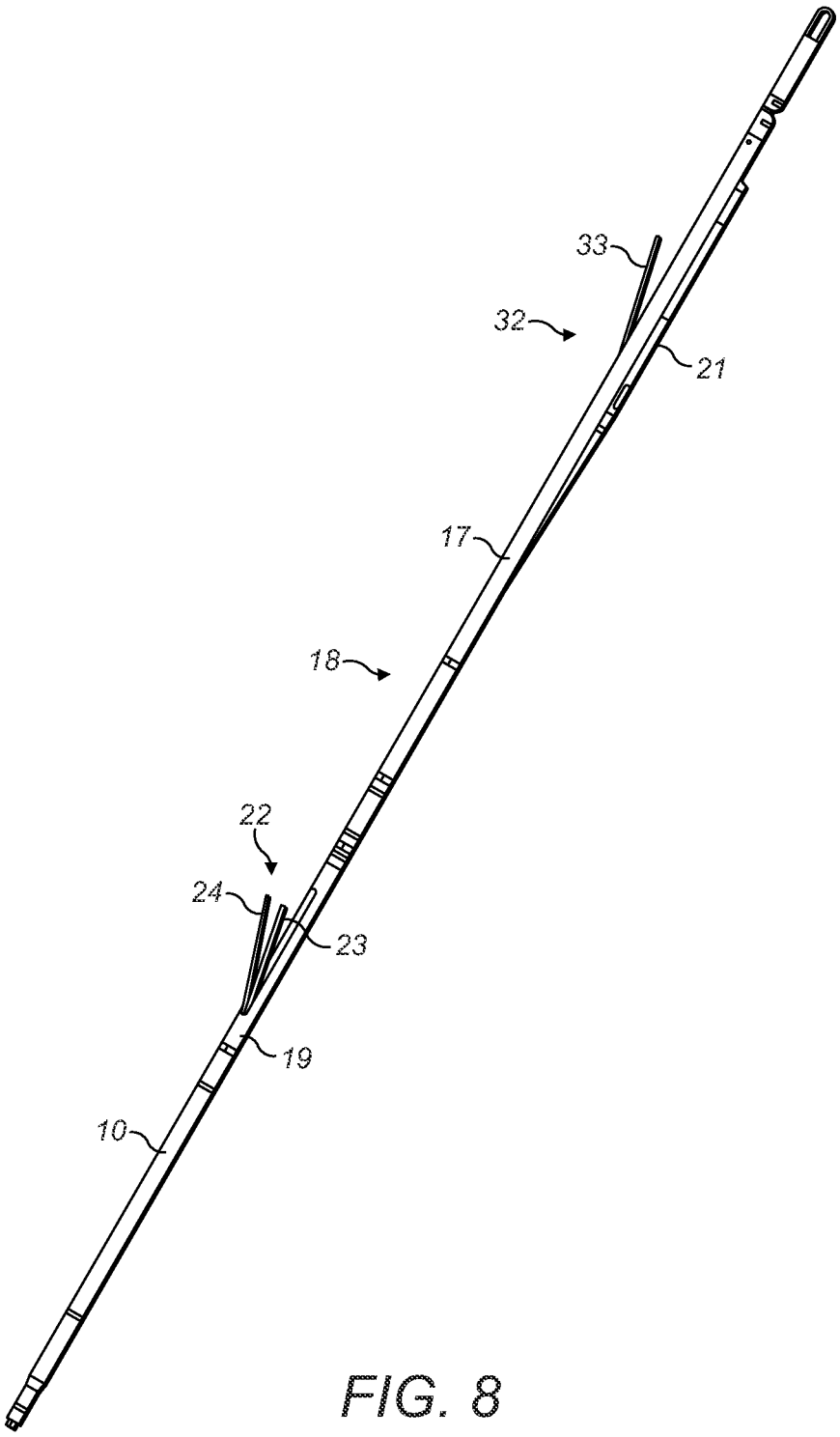
FIG. 8 is a perspective view of a logging toolstring including main and auxiliary stabilizers in accordance with the invention.

Referring to the drawings, FIG. 8 shows a logging toolstring in accordance with the invention and including a neutron logging tool 10 secured to the uphole end of a Gamma density tool 17 by an intermediate stabilizer tool element 19 supporting a main stabilizer 22 as defined herein.

The manner of securing the tools together is known in the art, and the nature of the screw thread connection between the tool 10 and element 19 on the one hand; and element 19 and tool 17 on the other is such that the indicated components 10, 17 and 19 may be released from one another at a surface location.

In the embodiment shown the resulting toolstring 18 may be lowered on wireline attached by way of e.g. a conventional fishing neck releasably secured to the uphole end of the neutron tool 10.

Aside from the stabilizer arrangements described below, the elements of the toolstring 18 largely are conventional. In accordance with logging equipment technology in general a great many variations on the basic designs shown are possible. As an example only therefore FIG. 8 illustrates an arm 33 that is selectively extensible from a side of the tool body as shown.

In the preferred embodiment of the invention arm 33 performs three functions:

a) acting as an auxiliary stabilizer arm;

b) acting as a calliper to measure the diameter of the well; and c) acting to press a density shoe forming part of the logging tool 17 into the borehole wall.

Functions b) and c) are well known in the logging art and are not described in detail herein.

It is not essential that the arm 33 carries out all three functions identified, and in other embodiments of the invention, other components may provide the functions b) and c). Partly for this reason arm 33 is referred to as an "auxiliary stabilizer arm 33."

Figure 9:
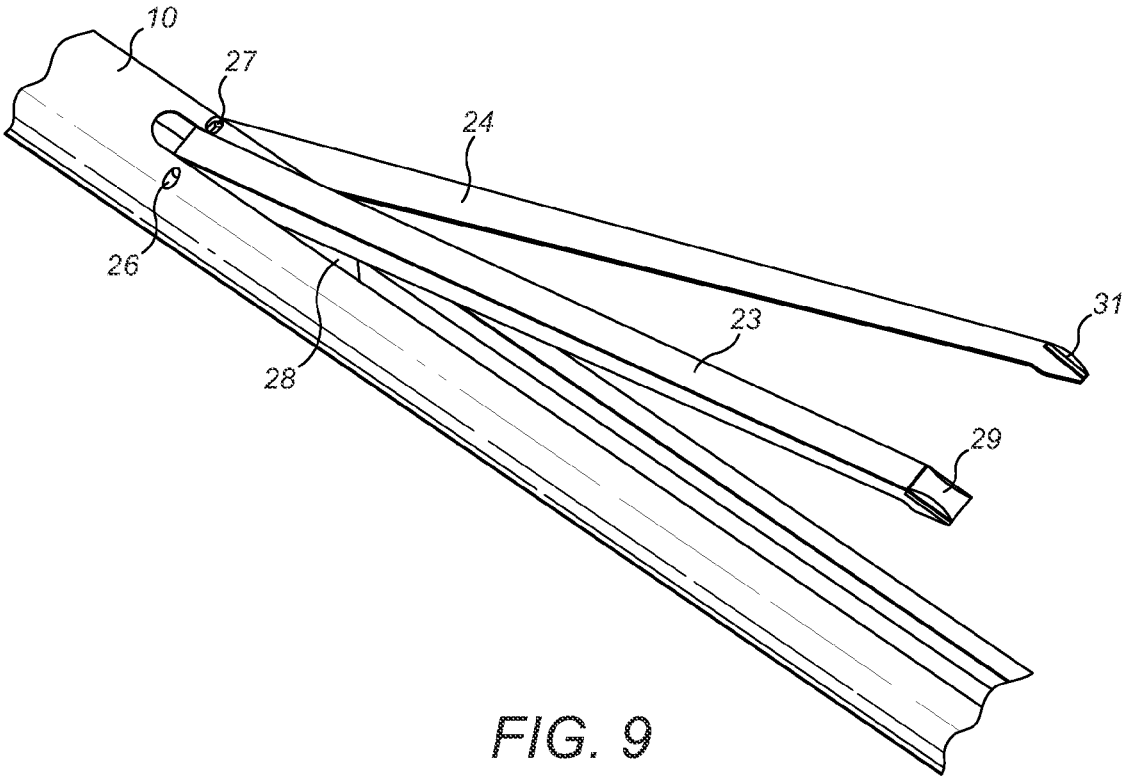
FIG. 9 is an enlarged, perspective view of part of the FIG. 8 apparatus, showing the arms of the main stabilizer.

Main stabilizer 22 includes a pair of rigid (e.g. steel or other metal alloy) main stabilizer arms 23, 24. Each of these is secured at one end to the body of the stabilizer tool 19 as best illustrated in FIG. 9. The attachments of the two arms 23, 24 are at the same distance along the tool 10 as one another.

The attachments of the ends of the main stabilizer arms 23, 24 are pivotable as signified by numerals 26 and 27 in FIG. 9 representing pivot pin recesses, associated with the respective arms 23, 24, in which per se known pivot pins (that are not visible in the drawings) are press-fitted during assembly of the stabilizer tool 19.

The pivot pin recesses are formed in lands at the sides of respective arm recesses, described in more detail below, of which one labelled 28 is visible in FIG. 9 as an elongate channel hollowed out (typically by machining) from the material of the exterior of the tool 19. The pivot pins as a result extend along notional chords defined in the circular cross-section of the stabilizer tool 19, such that the arms 23, 24 extend generally parallel to the elongate dimension of the toolstring.

The pivot pins retaining the respective main stabilizer arms 23, 24 are positioned and orientated such that the arms 23, 24 are moveable between relatively retracted positions in which they lie parallel to one another adjacent the exterior of the tool 19 and relatively advanced, i.e. extended, positions as illustrated in which they:

(i) diverge from one another; and (ii) define respective main arm free ends 29, 31 that are engageable with the wall (i.e. the interior surface) of a borehole in which the toolstring is operating.

The tool 19 includes a powered mechanism for effecting coordinated movement of the arms 23, 24 between the retracted and advanced positions. Providing for powered movement is important since it is necessary in use of the main stabilizer 22 to provide a substantial force between the logging tool and the borehole wall. In this regard the mass of a logging tool section might approach 50 kg with the result that a toolstring assembled from multiple tool elements might weigh 100 kg or more. The components of the main stabilizer 22 and the mechanism used for extending the main stabilizer arms 23, 24 must be capable of accommodating such masses and also with standing the harsh (e.g. high-pressure, chemically aggressive, high temperature) environment of the interior of a borehole. In consequence, the parts of the main stabilizer and indeed all the components described herein normally would be robustly engineered.

The powered mechanism may include e.g. one or more gear and pinion combinations, with the pinion drivingly coupled to a motor that may be electrically or hydraulically powered.

More specifically the gear may be a rack-type gear that extends longitudinally in and is moveable longitudinally along the interior of the main stabilizer 22.

At its end adjacent the respective pivot pin each main stabilizer arm 23, 24 may be formed as a part-circular pinion the teeth of which are in engagement with the teeth of the rack gear.

As a result, movement of the rack gear causes simultaneous movement of the arms 23, 24 between the retracted and advanced positions.

If during such motion only one of the arms 23, 24 is in contact with a borehole wall 100% (or very nearly 100%) of the force imparted by the rack gear acts through the arm 23, 24 that is in contact. If both the arms 23, 24 are in contact with one of them pressing the borehole wall more strongly than the other the rack gear force automatically applies in proportion to the force requirement of each arm.

Numerous other ways of embodying the mechanism are possible, but the above-described arrangement is simple, robust, and reliable and hence is preferred at present.

The arm recesses such as recess 28 in essence as stated are elongate channels formed in the outer surface of the tool 10. Each recess 28 is sufficiently long as to accommodate the whole length of the associated main stabilizer arm 23, 24. The pivot pins lie below the surface of the logging tool exterior in the regions of the lands such that the attached ends of the arms 23, 24 are permanently recessed at one end of the arm recesses. When the arms 23, 24 occupy their retracted positions they are received along their entire lengths in the arm recesses; and as shown when they occupy the advanced positions the major part of each arm 23, 24 protrudes from the tool 19.

Each arm free end 29, 31 includes a flattened tip portion as shown that in preferred embodiments of the invention is coated with a wear-resistant surface intended to provide stable engagement with the borehole wall. Other profiles than that shown may be employed within the scope of the invention.

Figure 5:
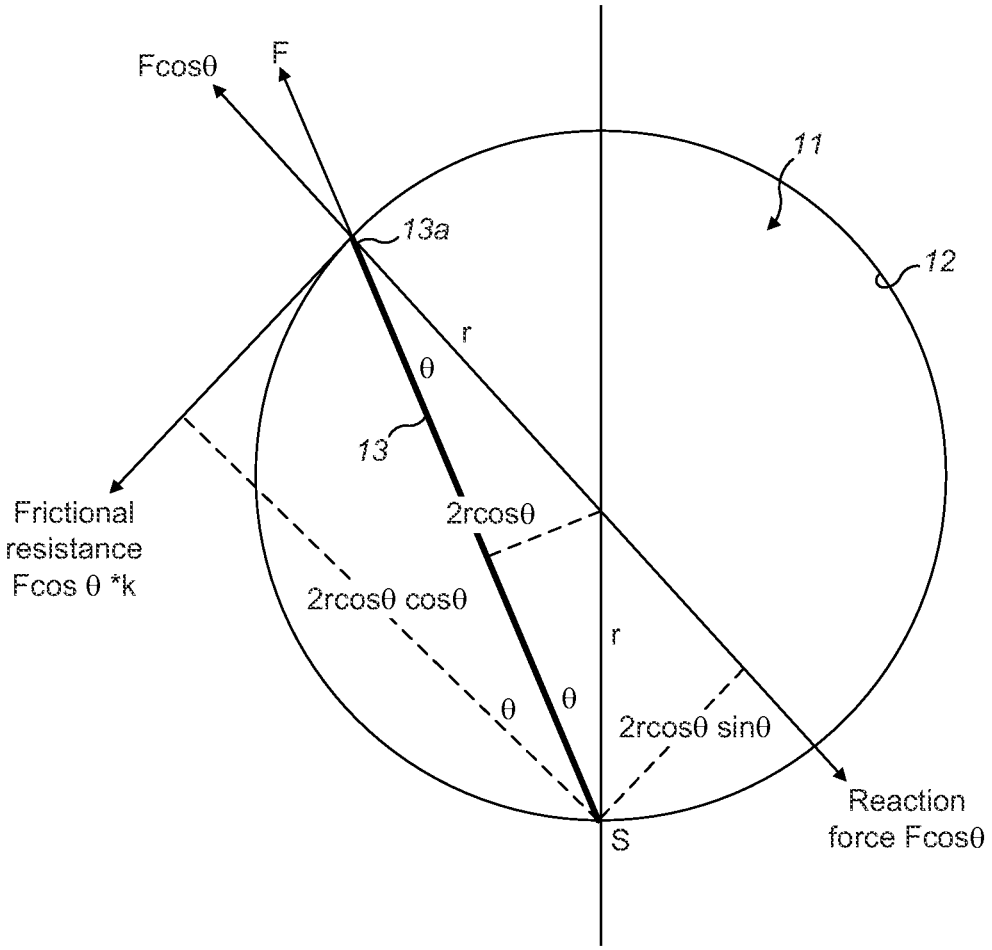
FIG. 5 is a schematic, cross-sectional view that is similar to FIGS. 1 to 4 and includes an analysis of forces acting on a single stabilizer arm.
Figure 6:
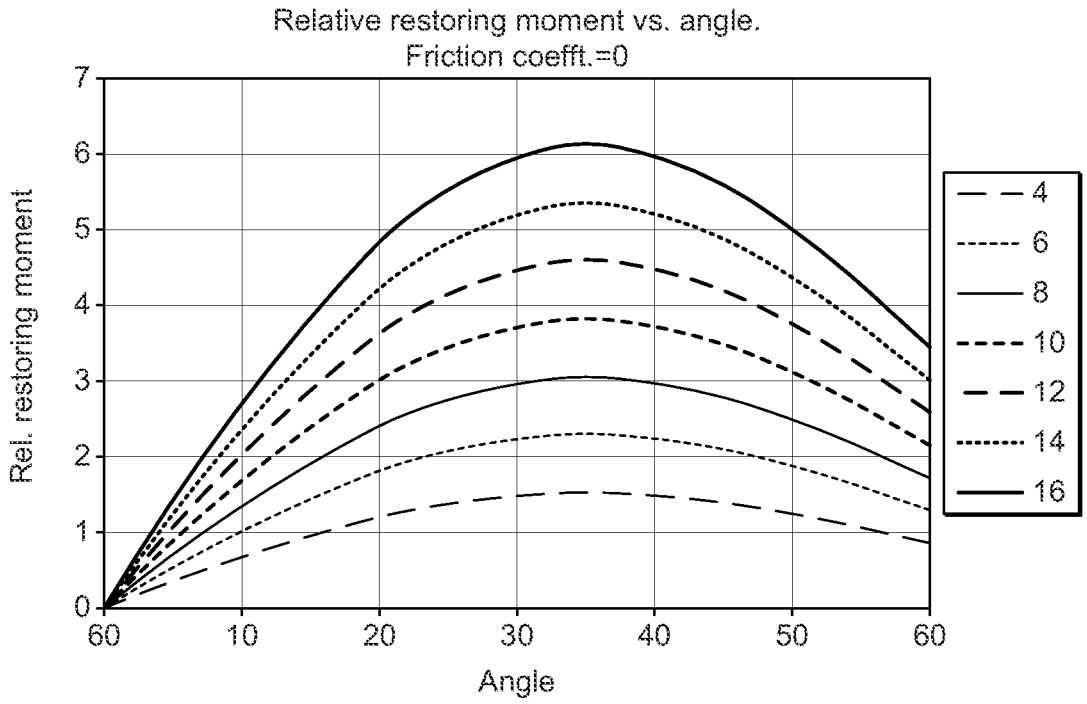
FIG. 6 is a sequence of plots of restoring force against orientation angle for various borehole sizes as represented in FIG. 5, assuming zero friction.
Figure 7:
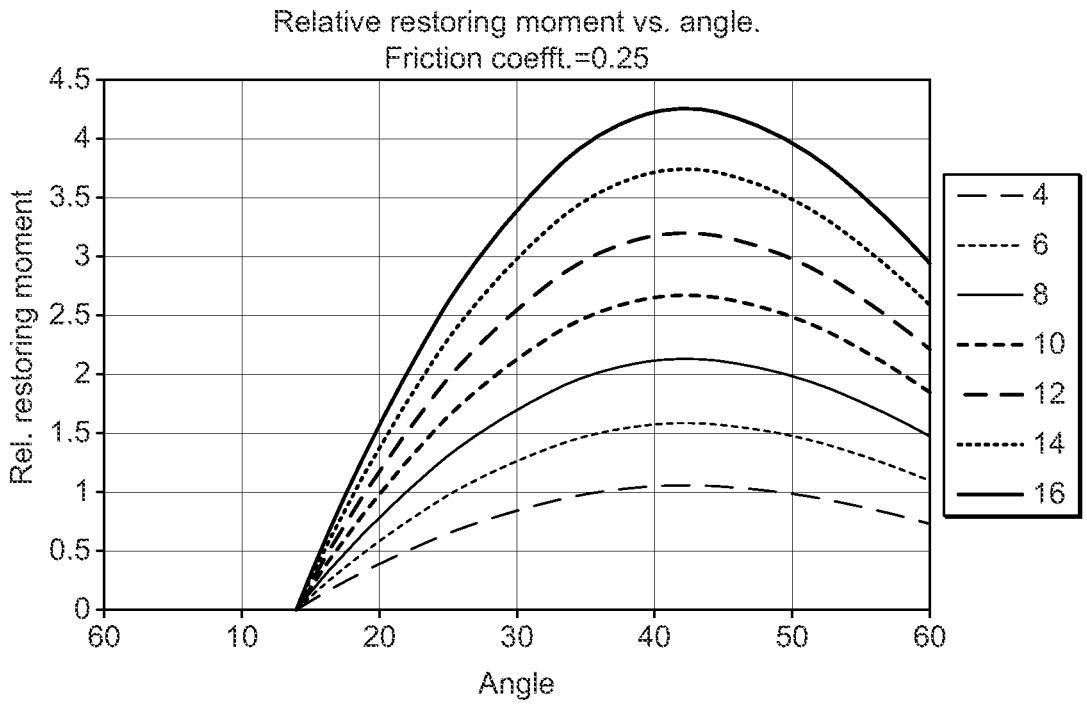
FIG. 7 is a sequence of plots that are similar to the FIG. 6 plots except that a coefficient of friction between the stabilizer arm and the borehole wall of 0.25 is assumed in order to exemplify the effects of friction.
Figure 10:
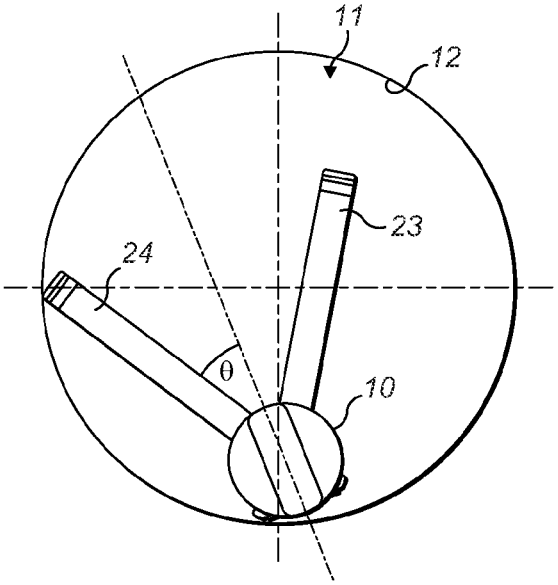
FIG. 10 shows in cross-sectional view a logging tool or toolstring, in accordance with the invention, in which a main stabilizer is in the process of stabilizing the logging tool housing.
Figure 11:
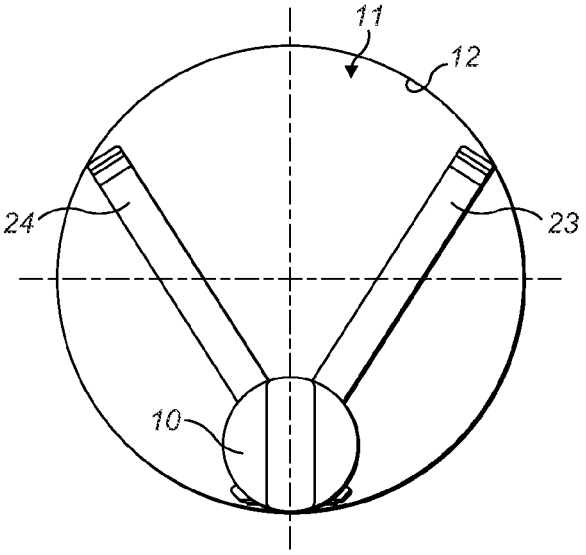
FIG. 11 shows the FIG. 10 components in a stabilised state.

As illustrated in FIGS. 10 and 11 when viewed end-on or in transverse cross-section the arms 23, 24 extend symmetrically from the exterior of the logging toolstring comprising tools 10, 17 and 19 secured together and give rise to the V-shape shown. As explained above in relation to the analysis of forces diagram that is FIG. 5, an optimal angle of divergence subtended between the arms 23, 24 is approximately 80 degrees. This gives rise to a maximal restoring force tending to stabilize a tilted logging tool.

Figure 1:
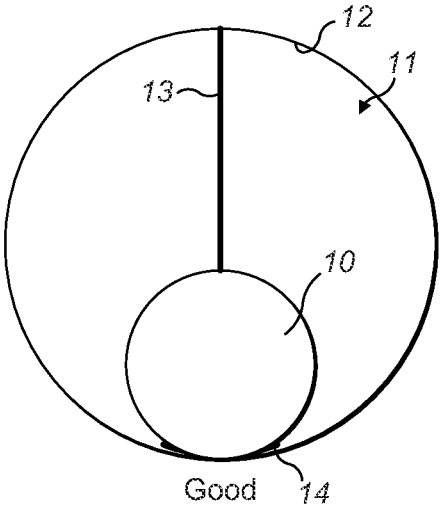
FIGS. 1 to 4 are schematic, cross sectional views showing some orientations that a logging tool having a single stabilizer arm may adopt within a borehole.
Figure 2:
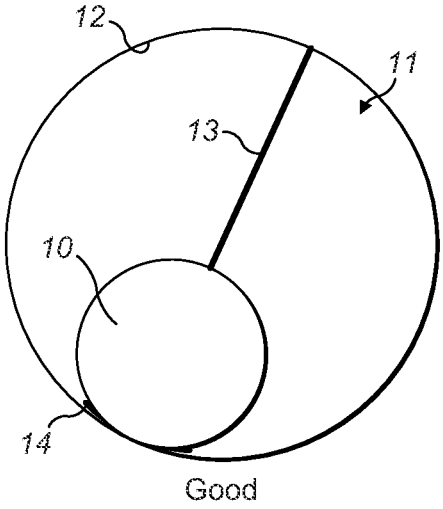
Figure 3:
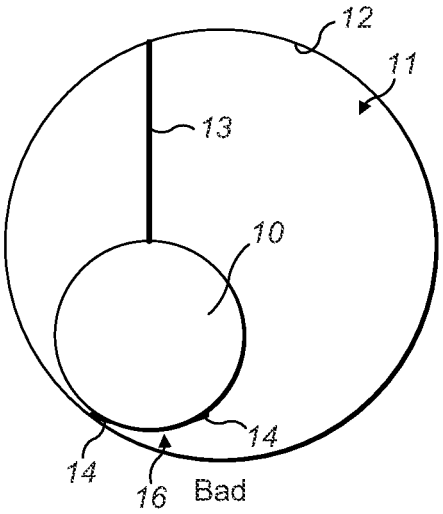
Figure 4:
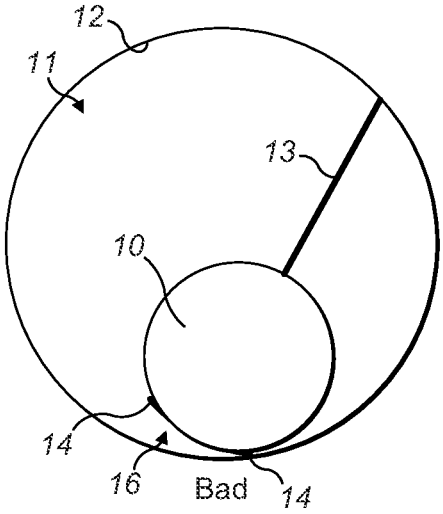

Operation of the main stabilizer 22 is illustrated by FIGS. 10 and 11. In FIG. 10 the logging tool 10 is tilted in a manner resembling the undesirable orientation shown in FIG. 4. However in FIGS. 10 and 11 as soon as the tool becomes "eccentric" relative to the borehole the entire force provided by the powered extension mechanism acts via (in the example illustrated) arm 24 that remains in contact with the borehole wall during tilting or other disturbance of the tool 10 from its correct orientation.

As is apparent from FIG. 10 at this time the angle θ subtended between the arm 24 and the bisector of the angle between the arms 23, 24 is half the V-angle between the arms. Since the latter is around 80-90 degrees as described the contact angle of the arm 24 with the borehole wall 12 is approximately 40 degrees and hence is such as to provide a maximal restoring force tending to restore the tool 10 to the orientation shown in FIG. 11. Thus, the stabilizer of the invention is capable of readily and rapidly restoring even a relatively heavy tool 11. In contrast, a stabilizer such as shown in FIGS. 1 to 5 having a single powered arm 13 would in the orientation shown in FIG. 10 present an angle θ of approximately zero degrees. This means that the net restoring force, taking account of the friction effect described above, in the prior art arrangement may be close to zero in some circumstances. This in turn means that the prior art stabilizer may be incapable of restoring the tool orientation as required.

Moreover, the arms 23, 24 by reason of their protrusion angles are shorter than the single arm 13 of FIGS. 1 to 4. This in turn means that even when deployed the stabilizer 22 of FIGS. 8 to 11 occupies less of the cross-sectional area of the borehole than a prior art single arm stabilizer. This further means that the stabilizer 22 permits operation in a larger diameter borehole than the prior art devices, in which the single arm 13 limits the extent to which the caliper may protrude on the opposite side of the toolstring 10, 17, 19.

Figure 12:
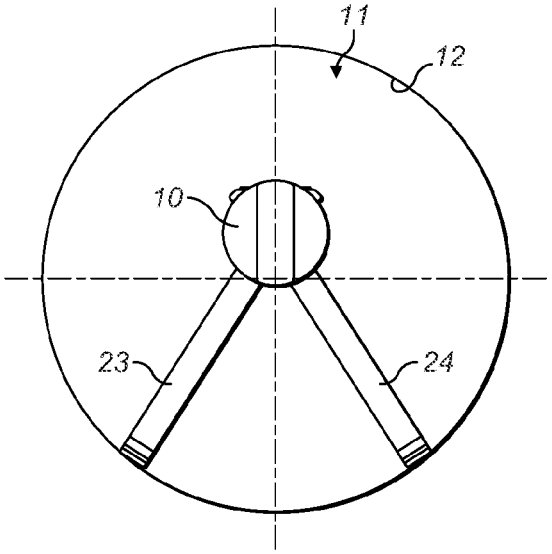
FIG. 12 is a view similar to FIGS. 10 and 11 showing a mode of inverted operation that can arise.

As illustrated in FIG. 12 however there is a theoretical chance of the stabilizer 22 operating when the tool 10 has rotated so that the arms 23, 24 protrude on its underside. In such a situation (depending on the orientation angle of the tool/toolstring 10, 17, 19) the arms 23, 24 when driven by the powered mechanism might cause stabilization of the tool in an inverted position as shown. In such a configuration at least the tool 10 is of essentially no use.

In order to ensure that the FIG. 12 result cannot arise therefore in preferred embodiments of the invention an auxiliary stabilizer 32 is provided. This consists of a single stabilizer arm 33 that is located at a location spaced along the logging tool 10 or toolstring 10, 17, 19 from the main stabilizer 22.

The auxiliary stabilizer arm 33 is of similar design to one of the main stabilizer arms 23, 24 and is secured at one end to the logging tool or toolstring by way of a pivot pin in like manner to the arms 23, 24.

An auxiliary powered mechanism and associated control device, that may be similar to the counterpart components that provide for powered movement of the arms 23, 24, is capable of causing powered movement of the auxiliary stabilizer arm 33 between relatively retracted and relatively advanced positions. In the latter the arm 33 is extended so as to protrude from the exterior of the tool or toolstring in an orientation that when viewed end-on or in cross-section bisects the V-angle between the arms 23, 24.

In the retracted position the auxiliary stabilizer arm 33 occupies a recess (not shown in the drawings) that is similar to the recess 28 described above. As a result no part of the arm 33 protrudes outwardly of the tool exterior when in the retracted position.

The powered mechanism and any control device associated with it are such as, on deployment of the apparatus of the invention to prevent or correct disturbance of the tool or toolstring, to cause movement of the auxiliary stabilizer arm 33 before the main stabilizer arms 23, 24 deploy simultaneously to their relatively advanced positions.

Figure 13:
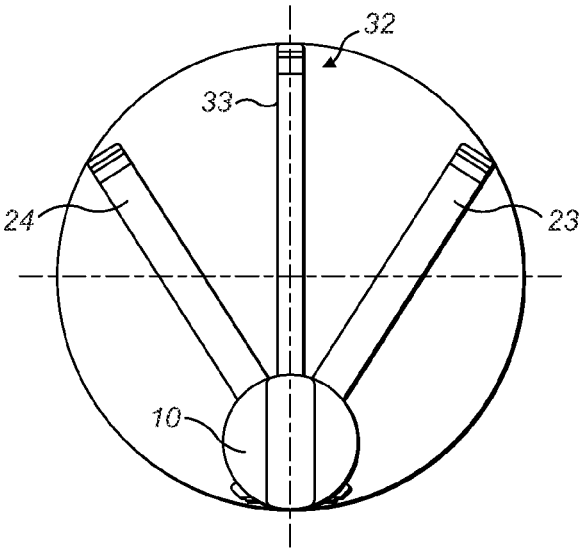
FIG. 13 illustrates the action of the optional auxiliary stabilizer in preventing the FIG. 12 mode from arising.

This prevents the situation shown in FIG. 12 from arising. The toolstring in which all three arms 23, 24, 32 are deployed is shown in FIG. 13. It is apparent from this figure that as long as the auxiliary stabilizer arm 33, which is longer than each of the arms 23, 24, deploys first so as to occupy a major part of the diameter of the borehole 11 and engage the borehole wall first the main stabilizer arms 23, 24 (which subsequently engage the borehole wall as shown) cannot cause the FIG. 12 situation to occur.

In addition to its functions as described the auxiliary stabilizer arm may as indicated above additionally provide e.g. the force to press a section of tool 17 against the wall of the well-bore. This would occur when tool 17 is a density tool as is well known in the art.

In the preferred embodiment of the invention shown in FIG. 8 the auxiliary stabilizer arm 33 is attached to the density logging tool 17 that is distinct from, and releasably secured to, the neutron density tool 10 (via (in the embodiment shown) the stabilizer tool element 19). However in other embodiments of the invention the main and auxiliary stabilizers 22, 32 could be formed spaced from one another along one and the same tool; and in yet further embodiments the main stabilizer 22 could be formed integrally with a first logging tool having secured directly to it (without the stabilizer tool element 19) a second logging tool supporting the auxiliary stabilizer 32. It is also possible within the scope of the invention to provide multiple main and/or multiple auxiliary stabilizers of the kinds described herein, as desired.

The control device that controls operation of the stabilizers 22, 32 could be common to them or could be constituted by separate devices that co-operate once the tools 10, 17 and 19 are secured together. The control device could be or include a microprocessor or other programmable device that is located on-board one of the tools 10, 17 or 19 or is at a surface location and in electronic or other communication with the tools 10, 17, 19 as necessary. Various combinations of control arrangements are possible and will occur to the skilled reader.

Use of the apparatus of the invention essentially is as described above. Once the auxiliary stabilizer arm 33 (if present) and the main stabilizer arms 23, 24 have been moved to their advanced positions following deployment of the tool 10 or toolstring 10, 17, 19 in a borehole the latter may be withdrawn in a per se known manner typically at a speed of up to 1 km/h in order to log the borehole. At the end of the logging activity the arms 23, 24 and 33 may be withdrawn to their retracted positions in the respective recesses in order to permit retrieval of the tool 10/toolstring 10, 17, 19 from the borehole. Since at this time no part of either stabilizer 22, 32 protrudes beyond the outer periphery of its associated tool 10, 17, 19 shuttling of the tool(s) is possible for the purpose of withdrawing them to the tophole end of the borehole.

Depending on the precise design of the tools employed this may either be the end of the tool activity because of real-time transmission of the log data e.g. using wireline, or it may be necessary to download data from an on-board memory forming part of the tool 10/toolstring 10, 17. Either method is within the scope of the invention.

Overall the apparatuses and methods described herein obviate a problem that is time-consuming and hence expensive, in a manner not suggested by either the prior art single arm stabilizer designs or the V-bowspring designs. The invention offers considerably greater flexibility and useability of logging tools including stabilizer mechanisms than has been the case hitherto.

The listing or discussion of an apparently prior-published document in this specification should not necessarily be taken as an acknowledgement that the document is part of the state of the art or is common general knowledge.

The invention claimed is:

1. A well logging apparatus having an outer surface, the outer surface having a first side for engaging a borehole surface of a borehole and having a second side opposite the first side, the well logging apparatus comprising:

a main stabilizer including a pair of moveable, rigid, main stabilizer arms that each are pivotably secured adjacent to one another and equally disposed about a first point on the second side of the outer surface at one end to the well logging apparatus so as to be moveable between a relatively retracted position on the one hand and a relatively advanced position on the other in which the main stabilizer arms diverge from one another and protrude from the second side of the outer surface of the well logging apparatus so as to present a pair of main arm free ends that are spaced from the outer surface of the well logging apparatus and are engageable with the borehole surface of the borehole; and a mechanism for effecting coordinated, powered, linked movement of the main stabilizer arms between the retracted and advanced positions, wherein the well logging apparatus is capable of being withdrawn along said borehole with the main stabilizer arms forcing the first side of the outer surface against the borehole surface when the main arm free ends are engaged with said borehole surface.

2. The well logging apparatus according to claim 1, wherein the mechanism allocates the stabilizing force via the main stabilizer arms in proportion to the borehole wall force experienced by each of the arms.

3. The well logging apparatus according to claim 1, including formed in the outer surface thereof one or more recesses each for receiving therein at least one of the main stabilizer arms so that in the relatively retracted position the main stabilizer arms are flush with or are recessed relative to the said outer surface.

4. The well logging apparatus according to claim 1, including formed in the outer surface thereof a pair of recesses in the form of slots that are each capable of receiving a respective rigid arm.

5. The well logging apparatus according to claim 1, wherein each main arm free end includes a portion that is shaped to promote stable engagement with said borehole surface.

6. The well logging apparatus according to claim 5, wherein each said portion includes a tip that is flattened in a region that is engageable with a borehole wall.

7. The well logging apparatus according to claim 1, wherein when the main stabilizer arms occupy their advanced position they subtend an angle of approximately 80 degrees.

8. The well logging apparatus according to claim 1, further including an auxiliary stabilizer having a moveable, rigid auxiliary stabilizer arm that is pivotably secured at a second point on the second side of the outer surface at another end to the well logging apparatus so as to be moveable between a relatively retracted position on the one hand and a relatively advanced position on the other in which the auxiliary stabilizer arm protrudes from the well logging apparatus so as to present a further free end that is spaced from the outer surface of the well logging apparatus and, along the length of the well logging apparatus, from the free ends of the main stabilizer arms; and that is engageable with said borehole surface.

9. The well logging apparatus according to claim 8, wherein the auxiliary stabilizer is controlled and/or driven independently of the main stabilizer.

10. The well logging apparatus according to claim 8, including a recess for receiving therein the auxiliary stabilizer arm so that in its relatively retracted position the auxiliary stabilizer arm is flush with or recessed relative to the said outer surface.

11. The well logging apparatus according to claim 8, wherein in its advanced position the auxiliary arm aligns with a plane generally bisecting an angle subtended between the main stabilizer arms when in their advanced positions.

12. The well logging apparatus according to claim 8, including a mechanism for effecting powered movement of the auxiliary stabilizer arm between its retracted and advanced positions.

13. The well logging apparatus according to claim 8, including a mechanism for effecting powered movement of the auxiliary stabilizer arm between its retracted and advanced positions and a control device that causes movement of the auxiliary and main stabilizer arms in a sequence in which the auxiliary stabilizer arm adopts its advanced position before the main stabilizer arms adopt their advanced positions.

14. The well logging apparatus according to claim 8, including at least first and second separable parts that in use are secured one to the other, the main stabilizer arms being pivotably secured to the first part and the auxiliary stabilizer arm being secured to the second part.

15. The well logging apparatus according to claim 14, wherein the first part is or includes a neutron logging tool.

16. The well logging apparatus according to claim 14, wherein the second part is or includes a resistivity logging tool or a density logging tool.

17. The well logging apparatus according to claim 8, including at least first and second separable parts that in use are secured one to the other, wherein at least one of the stabilizers is secured to a stabilizer element that is distinct from and connectable to the first and second separable parts so as to interconnect them.

18. The well logging apparatus according to claim 1, including or having operatively connected thereto one or more of a caliper, shoe or crank.

19. A method of stabilizing a well logging apparatus having an outer surface, the outer surface having a first side for engaging a borehole surface of a borehole and having a second side opposite the first side, the method comprising:

providing a main stabilizer including a pair of moveable, rigid, linked main stabilizer arms that each are pivotably secured adjacent to one another and equally disposed about a first point on the second side of the outer surface at one end to the well logging apparatus so as to be moveable between a relatively retracted position on the one hand and a relatively advanced position on the other in which the main stabilizer arms diverge from one another and protrude from the second side of the outer surface of the well logging apparatus so as to present a pair of main arm free ends that are spaced from the outer surface of the well logging apparatus and are engageable with the borehole surface of the borehole, and an auxiliary stabilizer having a moveable, rigid auxiliary stabilizer arm that is pivotably secured at a second point on the second side of the outer surface at another end to the well logging apparatus so as to be moveable between a relatively retracted position on the one hand and a relatively advanced position on the other in which the auxiliary stabilizer arm protrudes from the logging apparatus so as to present a further free end that is spaced from the outer surface of the well logging apparatus and, along the length of the well logging apparatus, from the free ends of the main stabilizer arms; and the method including the steps of (i) causing the auxiliary stabilizer arm to move from its retracted to its advanced position before (ii) causing the main stabilizer arms to move from their retracted positions to their advanced positions and (iii) causing withdrawal of the well logging apparatus along said borehole with at least the main stabilizer arms forcing the first side of the outer surface against the borehole surface.

20. The method according to claim 19, wherein the steps (i) and (ii) take place when the main and auxiliary stabilizer arms are within the borehole, the method further including the steps of (iii) causing the auxiliary stabilizer arm to engage the surface of the borehole before (iv) causing at least one main stabilizer arms to engage the surface of the borehole.

21. The method according to claim 19, wherein the steps (i) and (ii) take place when the main and auxiliary stabilizer arms are within the borehole, the method further including the steps of (iii) causing the auxiliary stabilizer arm to engage the surface of the borehole before (iv) causing at least one main stabilizer arms to engage the surface of the borehole and including causing the main stabilizer arms to move simultaneously from their retracted positions to their advanced positions.

22. The method according to claim 19, including operating one or more control devices controlling one or more mechanisms for effecting coordinated, powered, linked movement of the main stabilizer arms between the retracted and advanced positions.

23. The method according to claim 19, including operating one or more control devices controlling one or more mechanisms for effecting powered movement of the auxiliary stabilizer arm between its retracted and advanced positions.

24. The method according to claim 19, further including the step of (v) of causing the main and auxiliary stabilizer arms to move from their advanced to their retracted positions.

25. The method according to claim 19, including the step of causing the main and auxiliary stabilizer arms when in their retracted positions to occupy recesses formed in one or more outer surfaces of the well logging apparatus so that each said stabilizer arm is flush with or is recessed relative to the outer surface.

26. The method according to claim 19, further comprising logging at least part of the borehole.

27. The method according to claim 26, including carrying out the steps of (i) causing the main and auxiliary stabilizer arms to move from their advanced to their retracted positions or (ii) causing the main and auxiliary stabilizer arms when in their retracted positions to occupy recesses formed in one or more outer surfaces of the well logging apparatus so that each said stabilizer arm is flush with or is recessed relative to the outer surface, following logging of at least part of the borehole.

* * * * *